US005222473A

United States Patent [19]

Lint

[11] Patent Number: 5,222,473

[45] Date of Patent: Jun. 29, 1993

[54] BOW PRESS

[76] Inventor: Gary T. Lint, 14312 McCown Rd. NE., Newark, Ohio 43055

[21] Appl. No.: 915,250

[22] Filed: Jul. 20, 1992

[51] Int. Cl.[5] ..... F41B 5/14

[52] U.S. Cl. ..... 124/86; 124/1; 124/23.1

[58] Field of Search ..... 124/1, 23.1, 86, 88, 124/90; 29/244, 252; 73/161

[56] References Cited

U.S. PATENT DOCUMENTS

| | | | |
|---|---|---|---|
| 3,000,628 | 9/1961 | Kellogg . | |
| 3,055,655 | 9/1962 | Chelf . | |
| 4,074,409 | 2/1978 | Smith | 29/235 |
| 4,599,987 | 7/1986 | Rezmer | 124/23.1 |
| 4,993,397 | 2/1991 | Cryar et al. | 124/23.1 |
| 5,022,377 | 6/1991 | Stevens | 124/23.1 |
| 5,121,736 | 6/1992 | Hawk | 124/86 |

OTHER PUBLICATIONS

Spring Edition of 1992 of the Discount Warehouse, Inc. catalog for Bow Hunters, p. 47 and front cover.

*Primary Examiner*—Randolph A. Reese
*Assistant Examiner*—John Ricci
*Attorney, Agent, or Firm*—Sidney W. Millard

[57] ABSTRACT

A bow press includes pivotable arms on a linear frame. The bow fits on the press between two pegs projecting from the frame and a pair of prongs, one prong projecting from each arm. Simultaneous pivoting of the arms bends the limbs of the bow. Proper adjustment of the pegs and prongs prevents movement of the limb surface with respect to the pegs and prongs.

20 Claims, 1 Drawing Sheet

BOW PRESS

FIELD OF THE INVENTION

This invention relates in general to archery bows and more particularly, but not by way of limitation, to new and improved apparatus for changing bow strings, tension cable, wheels, etc., on an archer's compound bow and adjusting or tuning the bow and bow string.

BACKGROUND OF THE INVENTION

With the development of compound or split limb bows and the widespread use thereof, there has arisen the attendant problem of replacing defective or worn bow strings, tension cables, wheels, etc., and providing and maintaining the proper tension on the bow string.

As is well known to those skilled in the art, the most popular form of compound bow includes two or more eccentrically mounted pulleys or wheels pivotally attached relative the bow limbs and serving to support and control the movement of a bow string which in turn is connected to a tension cable. The popularity of the compound bow is mainly due to the advantage provided in the reduced pull force required at full draw together with the resulting increase in accuracy. The pull on the bow string is high at the beginning of the draw but the arm at this point is able to exert maximum force. As the draw progresses a little beyond mid-point, there is an overcenter action on the eccentrically mounted pulleys or wheels which decreases the draw force needed to maintain the bow string in the drawn position without decreasing the energy stored in the limbs of the bow. Thus, at full draw it is relatively easy to hold the arrow and bow string and much easier to perfect aiming technique and proper finger release resulting in increased accuracy.

As will be appreciated by those familiar with compound bows, the stringing or outfitting of such a bow with its tension cable and bow string is very critical in order to achieve a proper balance or synchronization of the eccentrically mounted pulleys or wheels. The stringing or rigging makes it virtually impossible to unstring the bow when it is not in use. Thus, the limbs of compound bows are always under significant stress, which eventually leads to a degradation of the limb materials, a stretching of the bow string and a reduction in the bow weight (the amount of force needed to flex the bow limbs to a condition of full draw of the bow string) with time for a given setting of the bow. This means that a periodic retuning of compound bows is needed to maintain desired performance levels. Also, over a period of time and with use, various elements of a compound bow, such as the bow string, the tension cable, a wheel or wheels, etc., need to be replaced and/or repaired.

In the prior art there are some devices which allow the bow string to be changed on a compound-type bow. For example, U.S. Pat. No. 3,055,655 discloses a bow press including a base with tiltable arms extending transversely therefrom. Each arm has on its remote end a roller which accommodates the tip ends of the limbs of the bow to be strung. The bow is supported on the rollers and a stirrup is buckled to the handle with the concave portion of the bow facing upward. A foot placed in the stirrup is used to depress the handle, flex the arms, and restringing of the bow may be accomplished while the foot remains in position.

U.S. Pat. No. 3,000,628 is even more primitive in that it secures a frame to a wall and two spaced spools are mounted extending transversely from the vertical framework. The handle of a bow fits in one spindle and one limb in the other. The bow is restrung by a manual operation with the operator pulling on the opposite limb of the bow to release tension on the string.

U.S. Pat. No. 4,074,409 discloses a bow stringing apparatus with attachment brackets for attaching a pull cord to the bow cables between the opposite eccentric pulley wheels and the bow string attachment points. It is a manual operation which allow no release prior to completion of restringing. The pull cord utilizes a low friction sheath member and a sliding locking bar for pulling tension on the bow and locking the bow in a compressed position while changing the bow string.

U.S. Pat. No. 4,599,987 discloses a bow press for restringing a split limb bow and includes a pair of spaced apart bars which engage the exterior of the limbs via slots formed therein. The bars are connected by cords. A rotatable lever is connected to the cords intermediate the bars. When manually rotated from a first position to a second position, the handle causes inward compression of the limbs toward each other. An adjustment rod, which is variable in length, reduces or extends the length between the two bars to accommodate bows of various sizes.

U.S. Pat. No. 5,022,377 provides for a frame having transversely extending pegs at its remote ends. A bow is mounted in the framework with the concave side facing upward and the limbs of the bow engaging the aforementioned pegs. A yolk fits over the handle and it is mounted on a threaded rod which passes through a mating threaded block secured to the framework. Rotation of the rod moves the yoke which pushes the handle away from the block and thereby flexes the limbs of the bow upward as the handle is depressed.

Three bow presses are displayed in the Spring Edition of 1992 of the Discount Warehouse, Inc. catalog for Bow Hunters and each involves a pulleytype arrangement where two cable connections are attached to a framework with their ends secured around a bow at the junction between the handle and the limbs. The framework in each case includes a roller at the remote ends of the framework and a pulley is used by hand operation to pull the handle down to deflect the limbs.

The problem with the prior art as identified above is the potential for separation which occurs as a result of rolling or sliding contact between transversely extending pegs on the framework and the laminated compound bow surface during the compression operation. The apparatus occasionally causes separation of the laminations and more frequently abrades the surface of the bow.

SUMMARY OF THE INVENTION

This invention is different in that it solves the problem by providing a framework to compress the bow to allow restringing, adjusting or any other repairs needed, but the whole operation is accomplished without differential movement between the bow surface and the restraining pegs and prongs on the framework.

This is accomplished by providing arms pivotally attached to a base plate or linear frame and providing that the arms pivot during the pressing operation such that the prongs on the arms remain stationary with respect to the surface of the bow as it is compressed.

Bows are of different sizes and accordingly the restraining pegs to engage the surface of the bow are adjustable. There are four pegs or prongs necessary for proper operation of the apparatus, two on the linear framework and one each on the arms extending longitudinally and generally parallel with the linear frame. For convenience in identifying the structure, the elements projecting from the linear frame are called pegs and the elements projecting from the pivotable arms are called prongs. The two pegs on the main frame or base plate are designed to engage the concave side of the bow at points where the handle ends and the limbs begin. Thereby any upward pressure which is expected from the prongs mounted on the arms of the frame causes the bow to flex essentially only in the limbs between the handle and the remote ends of the limbs.

Compression of the bow is accomplished by a hydraulic jack which raises a block in a framework. The framework guides the block along a path perpendicular to the linear frame. Struts are pivotally attached to the block and the remote end of each strut is pivotally attached to one of the arms projecting from the linear frame. Displacement of the block away from the linear frame pulls the arms in an arc toward the hydraulic jack thereby bending the limbs of the bow while essentially no relative movement takes place between the limbs of the bow and the engaging pegs on the base plate or the prongs on the arms of the frame.

Objects of the invention not understood from the above will be fully appreciated upon a review of the drawings and a reading of the Description of the Preferred Embodiment which follows.

DESCRIPTION OF THE PREFERRED EMBODIMENTS

Figure 1:
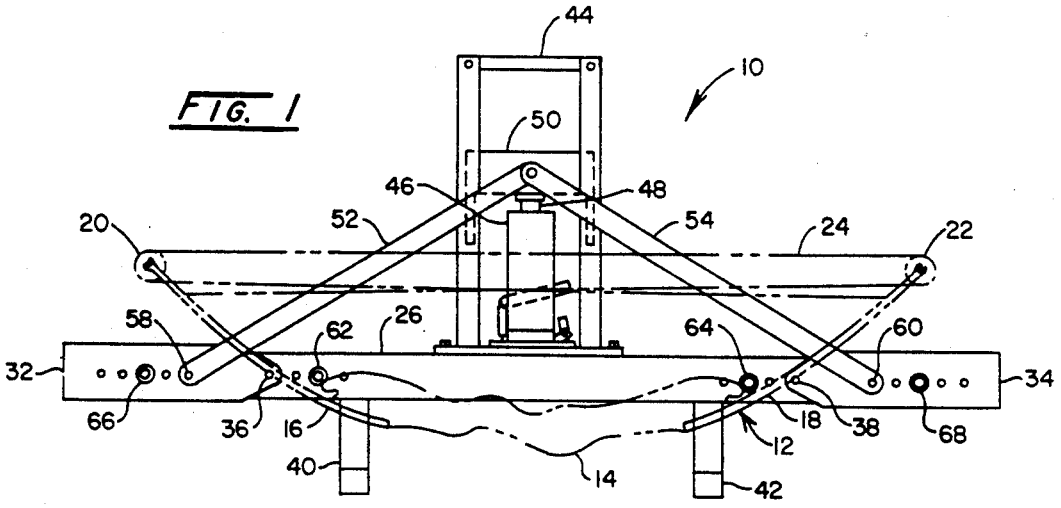
FIG. 1 is a side elevational view of a bow press according to this invention with a bow shown in phantom in initial position.

Looking to FIG. 1, a bow press 10 is shown in relaxed position to receive a compound bow 12. Conventional bows include a handle 14 and a pair of limbs 16, 18 projecting transversely thereof. At the distal end of each limb is a pulley 20, 22 and an associated bow string 24 stretches between the pulleys. The elements of the bow are conventional and need not be described herein.

Figure 3:
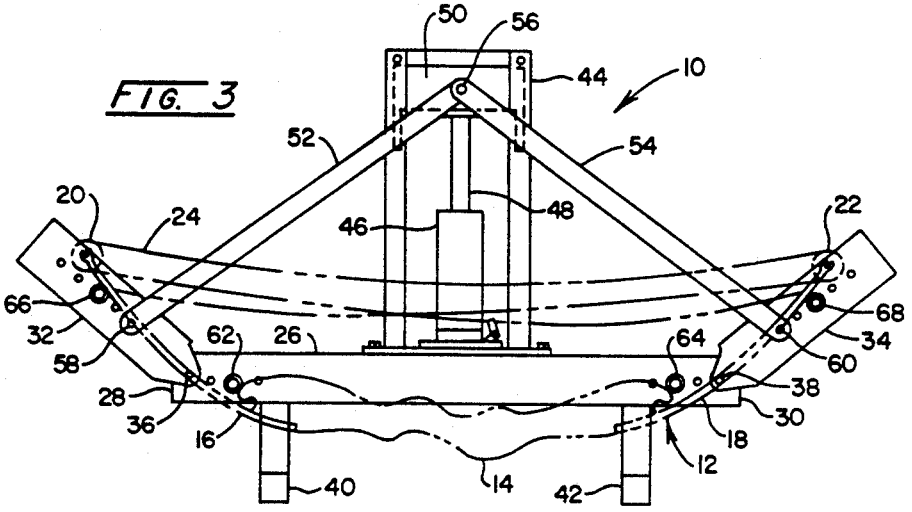
FIG. 3 is a side elevational view of the bow press of FIG. 1 but with the bow shown in deflected condition.

The bow press includes a base plate 26 having two ends 28, 30 (best seen in FIG. 3). Near each said end is an arm 32, 34; each arm is pivotally attached to the base 26 at a pivot point 36, 38. Preferably, each pivot point comprises a bolt and nut combination passing through apertures in the arms and the base plate. The arms 32, 34 are generally indicated as being U-shaped in cross-section and assembled straddling the ends 28, 30 of the base plate.

The base plate 26 is secured to a pair of T-shaped supports 40, 42 which may support the bow press above some substrate, not shown, which may be a table top, work bench, or the floor.

A hydraulic jack 46 is shown mounted in a framework 44 which is bolted to the upper surface of base plate 26. A piston rod 48 projecting from the upper end of jack 46 is aligned in framework 44 to be generally perpendicular to a straight line extending between pivot points 36, 38.

A block 50 is mounted on the upper end of rod 48 to slide within framework 44 upon the rising and failing of the rod with respect to the main body of the jack 46.

Two struts 52, 54 extend from the block 50 and one strut extends to one of the arms 32, 34. Each strut is pivotally attached to block 50 at 56 and the other end of each strut is pivotally attached to one of the arms at 58, 60.

Projecting transversely from the base plate are a pair of pegs 62, 64. Similarly, extending generally in the same direction from each of the arms 32, 34 are prongs 66, 68. Note that the pegs and prongs are intended to extend generally parallel with the axes of pivot points 36, 38 between the base plate and the arms 32, 34.

Figure 2:
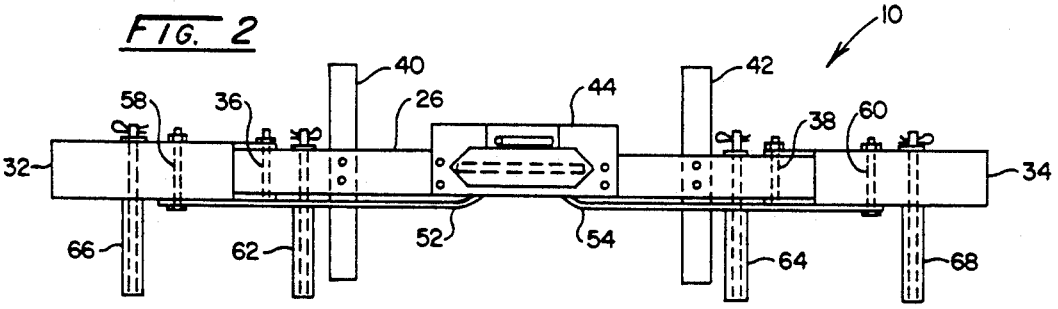
FIG. 2 is a top plan view of the bow press of FIG. 1.

The pegs and prongs are shown in FIG. 2 as circular bars projecting through apertures in the base plate of the arms. But, note that there are alternative apertures for mounting the pegs and prongs. In operation the pegs 62 and 64 are adjusted transversely such that they engage the concave side of the bow 12 on the arm surface immediately outward of the bow handle 14. After the pegs are suitably adjusted, the prongs 66, 68 are also adjusted to be at a location near the end of the associated arm 16, 18 such that there will be substantially no relative movement between the arm surface and the engaging surface of prongs 66, 68 upon a flexing of the bow by actuation of the jack 46 as will be explained subsequently.

To flex a bow to a position to change or adjust the bow string 24, the jack 46 is adjusted to allow the hydraulic fluid to compress the rod 48 into the jack body at its lowest position, see FIG. 1. That lowers the arms 32, 34 such that they extend generally co-extensively with a line extending between pivot points 36 and 38.

A bow 12 is placed in position such that its concave side is located to engage the padded surfaces of pegs 62, 64. The pegs are adjusted transversely on the plate 26 such that they engage the concave surface of the limbs immediately outward of the handle 12 as explained above. Thereafter the padded prongs 66, 68 are also adjusted transversely on the arms 32, 34 as explained above.

Hydraulic jack 46 is actuated by a conventional manual pumping action to cause hydraulic fluid to drive a piston upward, not shown. The piston is enclosed within the body of the jack 46 and its movement serves to elevate rod 48. As rod 48 moves vertically, generally perpendicular to a straight line extending between pivot points 36, 38, block 50 rises in the framework 44. As block 50 rises struts 52, 54 pull arms 32, 34 inwardly in an arc about pivot points 36, 38 until the bow arms 16, 18 are sufficiently deflected as to allow the string 24 to be manipulated as needed. Note that locations of the prongs and pegs are such that essentially all of the flexing of the bow takes place in the arms 16, 18 transversely of the handle 14 and this allows the strategic location of the prongs and pegs at positions which do not abrade or scar the surface of the arms because there is substantially no transverse movement between the padded pegs and prongs and the arms' surfaces.

While certain preferred embodiments of the present invention have been disclosed in detail, it is to be understood that various modifications may be adopted without departing from the spirit of the invention or scope of the following claims.

I claim:

1. A bow press for deflecting the limbs of a bow to allow replacement or adjustment of the bow string, the bow having a handle and two transversely extending limbs, each limb including means for attaching said bow string at a location remote from said handle, said press comprising, a base plate having two ends, an arm pivotally attached to each end of said plate, the pivot point of each said arm having an axis for pivoting said arm with respect to said plate, said axes being parallel, two struts, an end of one strut being pivotally attached to one arm, an end of the other strut being pivotally attached to the other arm, the other end of each strut being attached to a block, said block being mounted to reciprocate in a plane perpendicular to a straight line extending between the pivot axes of said arms, means for moving said block away from said base plate and thereby pivoting said arms toward said block, a pair of pegs projecting from said base plate generally parallel with each other and with said axes, one of said pegs being located near each said pivot point of said arms where they are attached to said plate, each arm including a prong projecting transversely of said arm and generally parallel with said pegs.

2. The bow press of claim 1 including means for adjusting the location of said prongs on said arms.

3. The bow press of claim 2 including means for adjusting the location of said pegs on said base plate.

4. The bow press of claim 3 wherein said prongs and pegs include an elastomeric covering for the areas of said prongs and pegs which are for engaging the bow.

5. The bow press of claim 4 wherein said block moving means comprises a hydraulically actuated piston and cylinder combination.

6. The bow press of claim 5 including means for maintaining said block within a path perpendicular to a line extending between the axes of said two arm pivot points.

7. The bow press of claim 6 wherein said maintaining means comprises a framework including two parallel guides, one said guide being located on each side of said block and between said block and the nearest said arm.

8. The bow press of claim 3 wherein said block moving means comprises a hydraulically actuated piston and cylinder combination.

9. The bow press of claim 8 including means for maintaining said block within a path perpendicular to a line extending between the axes of said two arm pivot points.

10. The bow press of claim 9 wherein said maintaining means comprises a framework including two parallel guides, one said guide being located on each side of said block and between said block and the nearest said arm.

11. The bow press of claim 1 including means for adjusting the location of said pegs on said base plate.

12. The bow press of claim 11 wherein said block moving means comprises a hydraulically actuated piston and cylinder combination.

13. The bow press of claim 12 including means for maintaining said block within a path perpendicular to a line extending between the axes of said two arm pivot points.

14. The bow press of claim 13 wherein said maintaining means comprises a framework including two parallel guides, one said guide being located on each side of said block and between said block and the nearest said arm.

15. The bow press of claim 1 wherein said block moving means comprises a hydraulically actuated piston and cylinder combination.

16. The bow press of claim 15 including means for maintaining said block within a path perpendicular to a line extending between the axes of said two arm pivot points.

17. The bow press of claim 16 wherein said maintaining means comprises a framework including two parallel guides, one said guide being located on each side of said block and between said block and the nearest said arm.

18. The bow press of claim 1 including means for maintaining said block within a path perpendicular to a line extending between the axes of said two arm pivot points.

19. The bow press of claim 18 wherein said maintaining means comprises a framework including two parallel guides, one said guide being located on each side of said block and between said block and the nearest said arm.

20. A method of bending a bow comprising, providing a bow press including a base plate with pivotal arms attached, providing a compound bow having a handle with two transversely extending arms, mounting pegs on said base plate to extend parallel to the pivot axes of said arms and spaced apart a distance just greater than the length of said handle, providing an apparatus to move a block along an axis perpendicular to a line extending between the pivot points of said arms, connecting one end of each of two struts to said block and connecting the other end of each said strut to one of said arms, mounting a prong on each said arm extending parallel with the axes of said arm pivot points, placing said bow in said press with the concave side of said bow limbs engaging said pegs at a location just beyond the handle of said bow, adjusting the locations of said prongs on said arms and bringing said prongs into engagement with the convex side of said bow limb at a location whereby said prongs will not move relative to said engagement upon pivoting movement of said arms, and moving said block away from said base plate to bend the bow.

* * * * *